US009272383B1

(12) United States Patent
Dickson

(10) Patent No.: US 9,272,383 B1
(45) Date of Patent: Mar. 1, 2016

(54) SURFACE PREPARATION APPARATUS

(75) Inventor: Wayne E. Dickson, Tecumseh, OK (US)

(73) Assignee: Dickson Industries, Inc., Tecumseh, OK (US)

( * ) Notice: Subject to any disclaimer, the term of this patent is extended or adjusted under 35 U.S.C. 154(b) by 763 days.

(21) Appl. No.: 13/308,243

(22) Filed: Nov. 30, 2011

(51) Int. Cl.

| | |
|---|---|
| ***B24B 7/18*** | (2006.01) |
| ***B24B 41/047*** | (2006.01) |
| ***B24B 23/03*** | (2006.01) |
| ***A47L 11/02*** | (2006.01) |
| ***A47L 11/10*** | (2006.01) |
| *B24B 55/10* | (2006.01) |

(52) U.S. Cl.
CPC . *B24B 7/18* (2013.01); *A47L 11/02* (2013.01); *A47L 11/10* (2013.01); *B24B 7/186* (2013.01); *B24B 23/03* (2013.01); *B24B 41/047* (2013.01); *B24B 55/102* (2013.01)

(58) Field of Classification Search
CPC ..... B24B 23/02; B24B 7/184; B24B 7/186; B24B 41/047; B24B 55/02; B24B 55/102; B24B 57/02; B24B 7/18; B24B 23/03; A47L 11/00; A47L 11/02; A47L 11/10; A47L 11/40
USPC ..... 451/350, 353
See application file for complete search history.

(56) References Cited

U.S. PATENT DOCUMENTS

| | | | | |
|---|---|---|---|---|
| 2,205,492 | A * | 6/1940 | Reid | 451/350 |
| 3,715,772 | A * | 2/1973 | Downing et al. | 451/344 |
| 3,903,658 | A * | 9/1975 | Daiuta | 451/359 |
| 3,908,220 | A * | 9/1975 | Adamson et al. | 15/50.1 |
| 4,219,898 | A * | 9/1980 | Presby | 15/49.1 |
| 4,783,872 | A * | 11/1988 | Burhoe | 451/359 |
| 5,341,536 | A * | 8/1994 | Hill | 451/351 |
| 5,593,342 | A * | 1/1997 | Thibaut | 451/159 |
| 5,643,047 | A * | 7/1997 | Beckett et al. | 451/6 |
| 6,273,799 | B1 * | 8/2001 | Pedrini | 451/159 |
| 6,494,773 | B1 * | 12/2002 | Marchini et al. | 451/353 |
| 6,904,989 | B2 * | 6/2005 | Hefter | 180/167 |
| 7,155,768 | B2 * | 1/2007 | Morita et al. | 451/351 |
| 7,247,085 | B1 * | 7/2007 | Anderson | 451/350 |
| 7,261,623 | B1 * | 8/2007 | Palushi | 451/350 |
| 2007/0155285 | A1 * | 7/2007 | Padgett et al. | 451/5 |

* cited by examiner

*Primary Examiner* — Monica Carter
*Assistant Examiner* — Marcel Dion
(74) *Attorney, Agent, or Firm* — McAfee & Taft

(57) ABSTRACT

The surface preparation apparatus includes a motor-powered wheeled vehicle and a grinding head assembly. The grinding head assembly may oscillate relative to the direction of the travel of the vehicle. The weight applied to the surface by the grinding head assembly may be varied from the weight of the grinding head assembly to zero.

18 Claims, 12 Drawing Sheets

SURFACE PREPARATION APPARATUS

SUMMARY OF THE INVENTION

The surface preparation apparatus disclosed herein comprises a motor-powered wheeled vehicle with a grinding head assembly connected to and movable therewith. The grinding head assembly includes a plurality of rotating tools. Each rotating tool may have a plurality of nodes thereon with grinding pucks affixed thereto. The motor that powers the vehicle causes the rotation of the rotatable tools. The grinding pucks will grind material from the surface over which the wheeled vehicle travels. The grinding pucks may have coarse or fine grit. Polishing pads may also be used with the rotating tools so that a concrete surface can be finished to an almost polished marble or polished granite appearance. The grinding head assembly may oscillate laterally relative to the direction of travel of the vehicle. A hydraulic cylinder mounted to a grinding head housing will reciprocate and cause the grinding head assembly to oscillate. The oscillation speed may be varied. The grinding head assembly is an adjustable weight grinding head assembly in that the amount of pressure applied to the surface can be varied. In one embodiment hydraulic cylinders are mounted at one end to the vehicle and a second end to a connecting structure that connects the vehicle and the grinding head assembly. The hydraulic cylinders are operable to adjust the weight applied by the grinding head assembly to the surface from a maximum weight of the grinding head to zero.

BRIEF DESCRIPTION OF THE DRAWINGS

FIG. 6 is a perspective view of the pivot bar connections.

DETAILED DESCRIPTION OF AN EMBODIMENT

Figure 1:
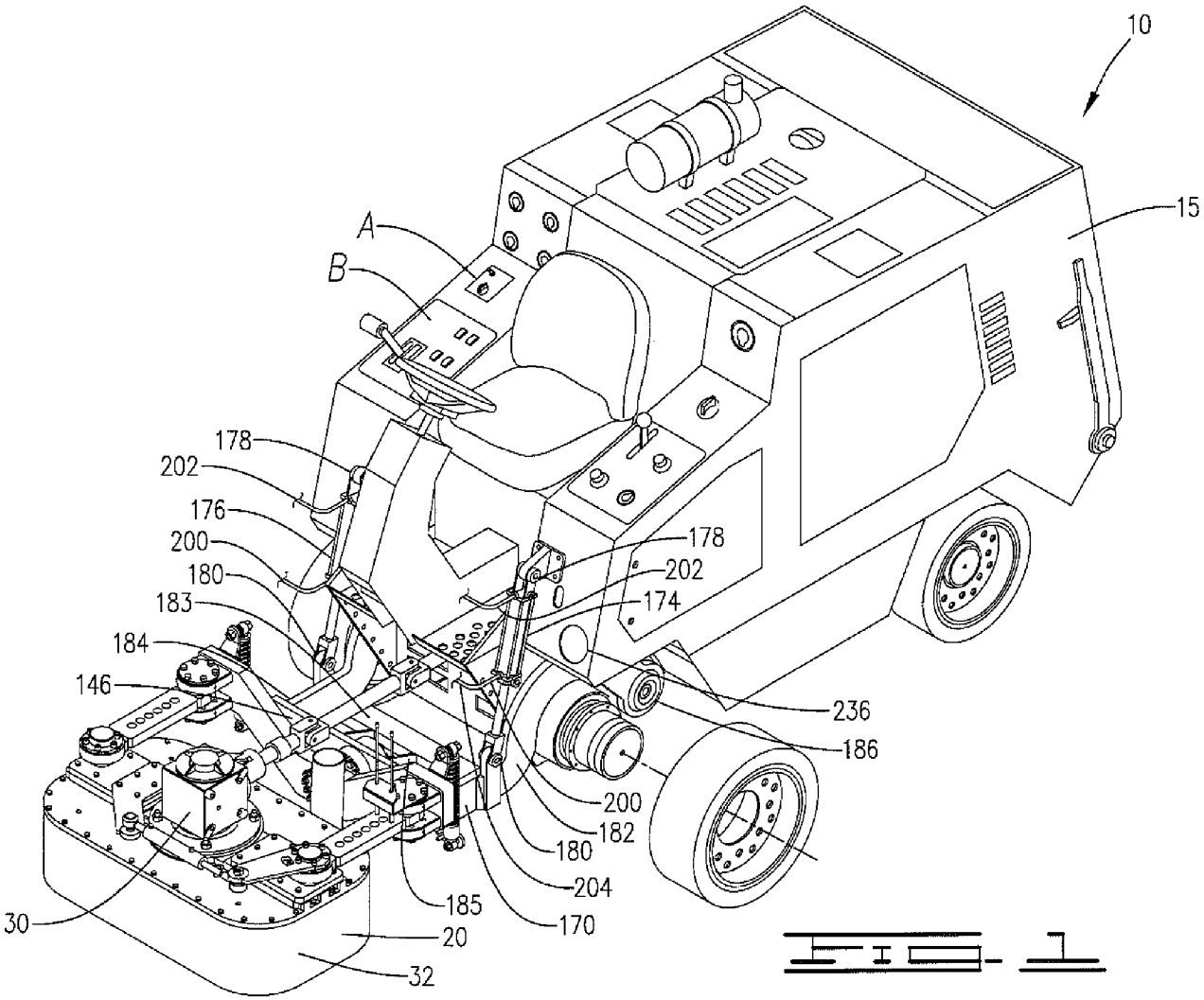
FIG. 1 is an isometric view of the surface preparation apparatus including a motor-powered wheeled vehicle with a grinding head connected thereto.
Figure 2:
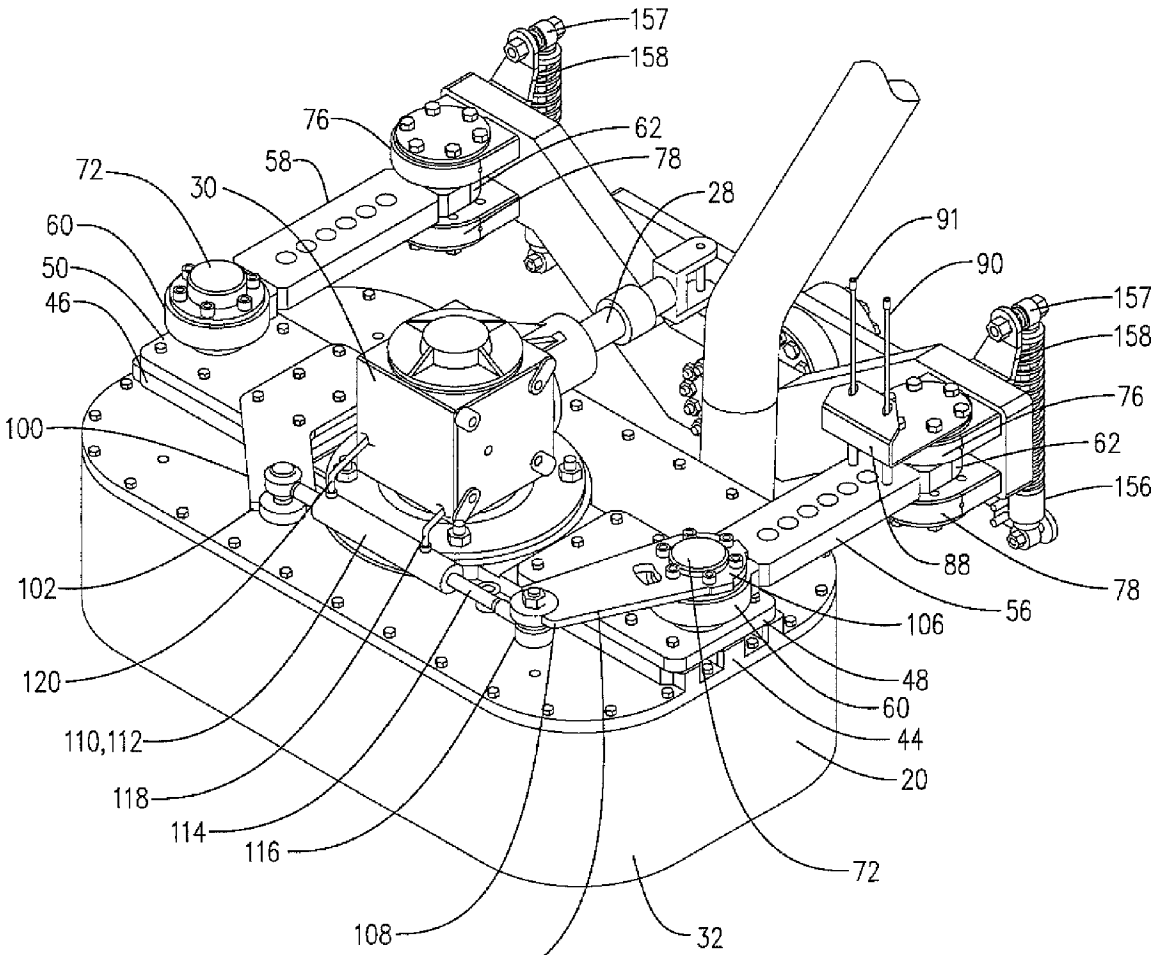
FIG. 2 is an isometric view of the front of the grinding head assembly of the surface preparation apparatus.
Figure 3:
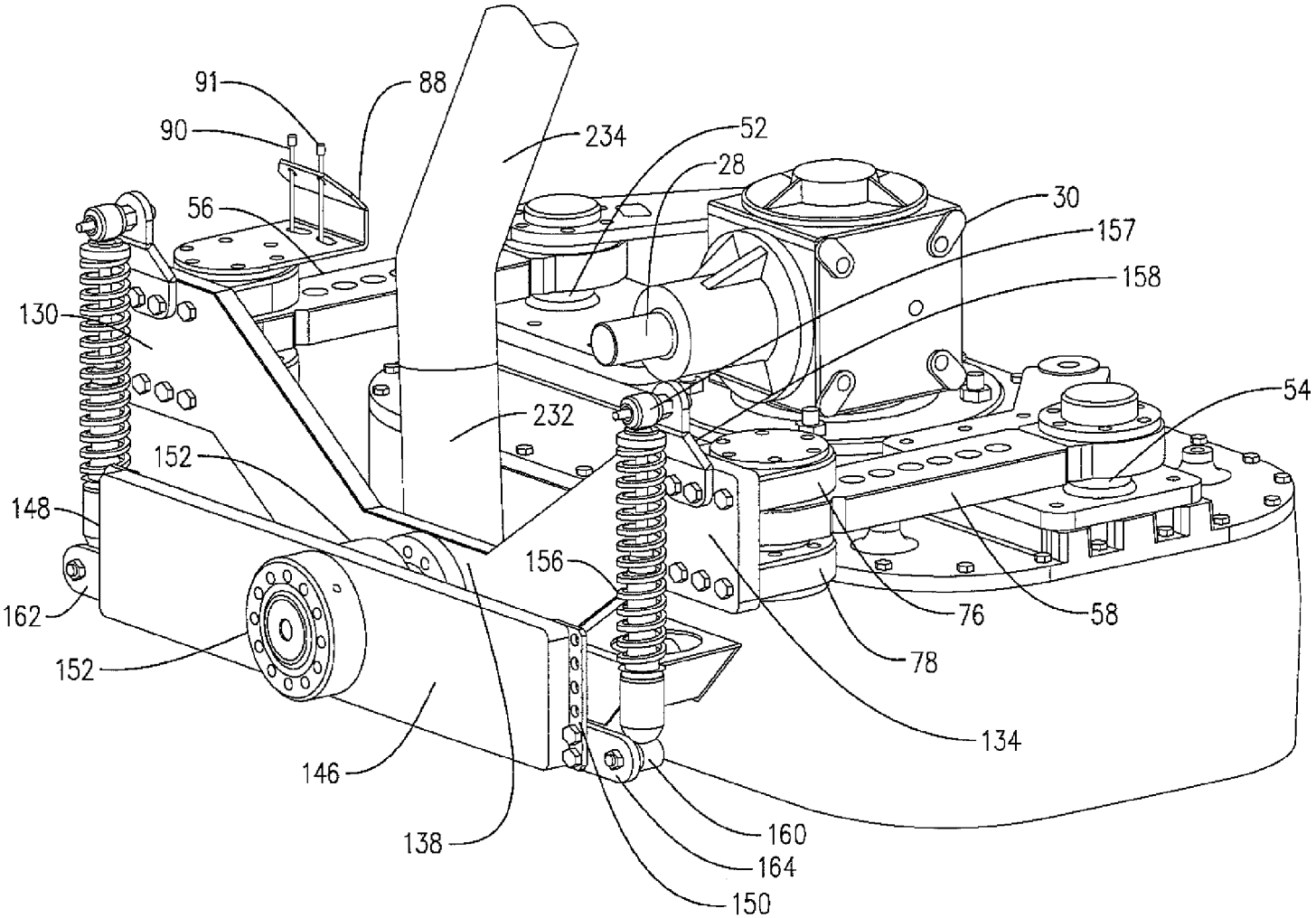
FIG. 3 is an isometric view of the rear of the grinding head assembly.
Figure 4:
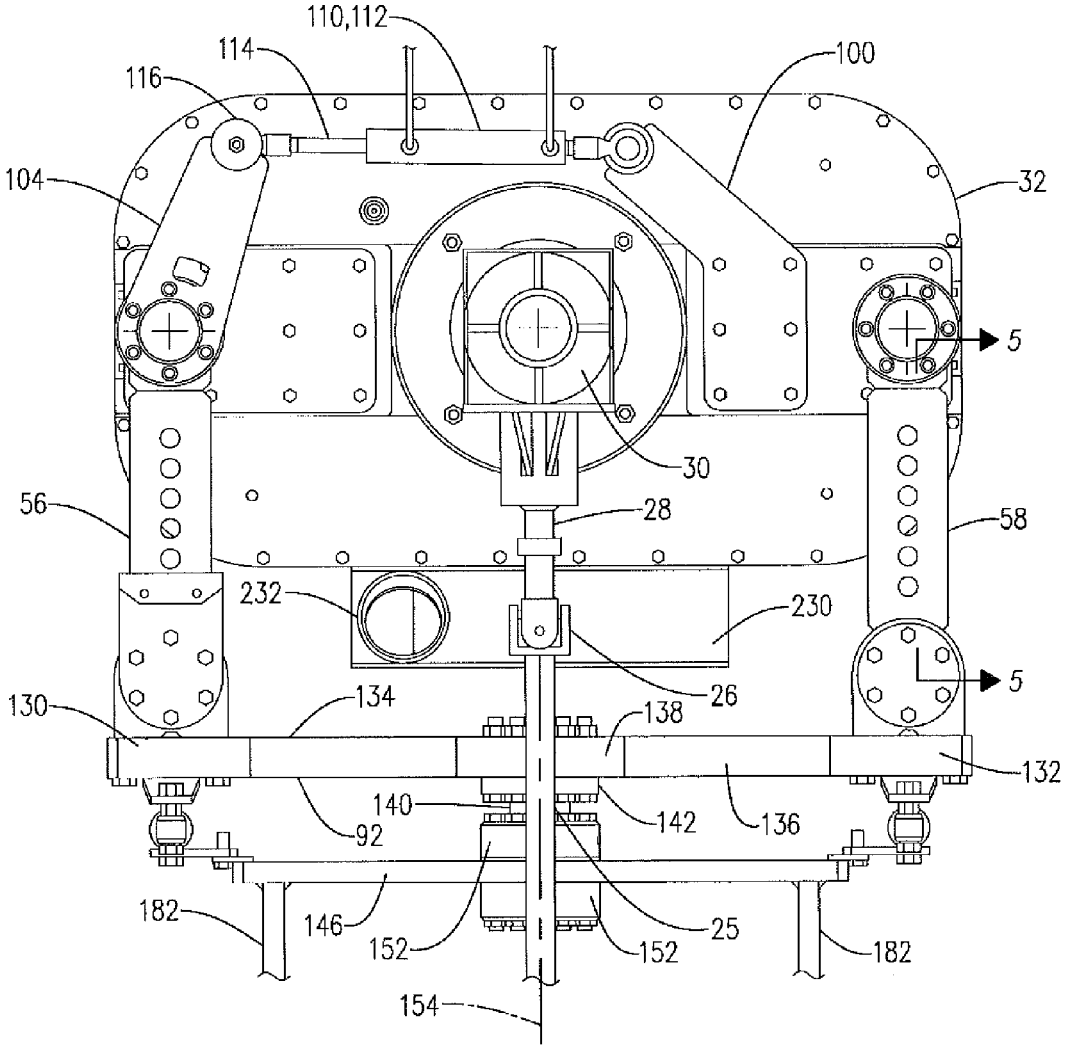
FIG. 4 is a top view of the grinding head assembly.
Figure 5:
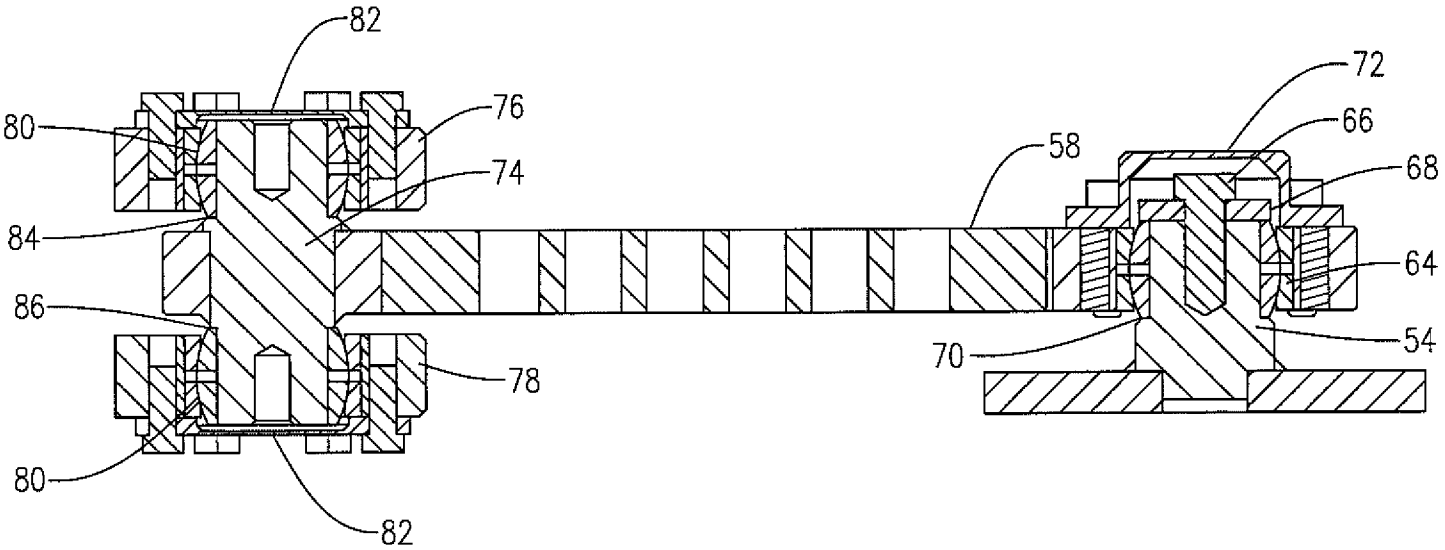
FIG. 5 is a section view taken from lines 5-5 of FIG. 4.
Figure 5:
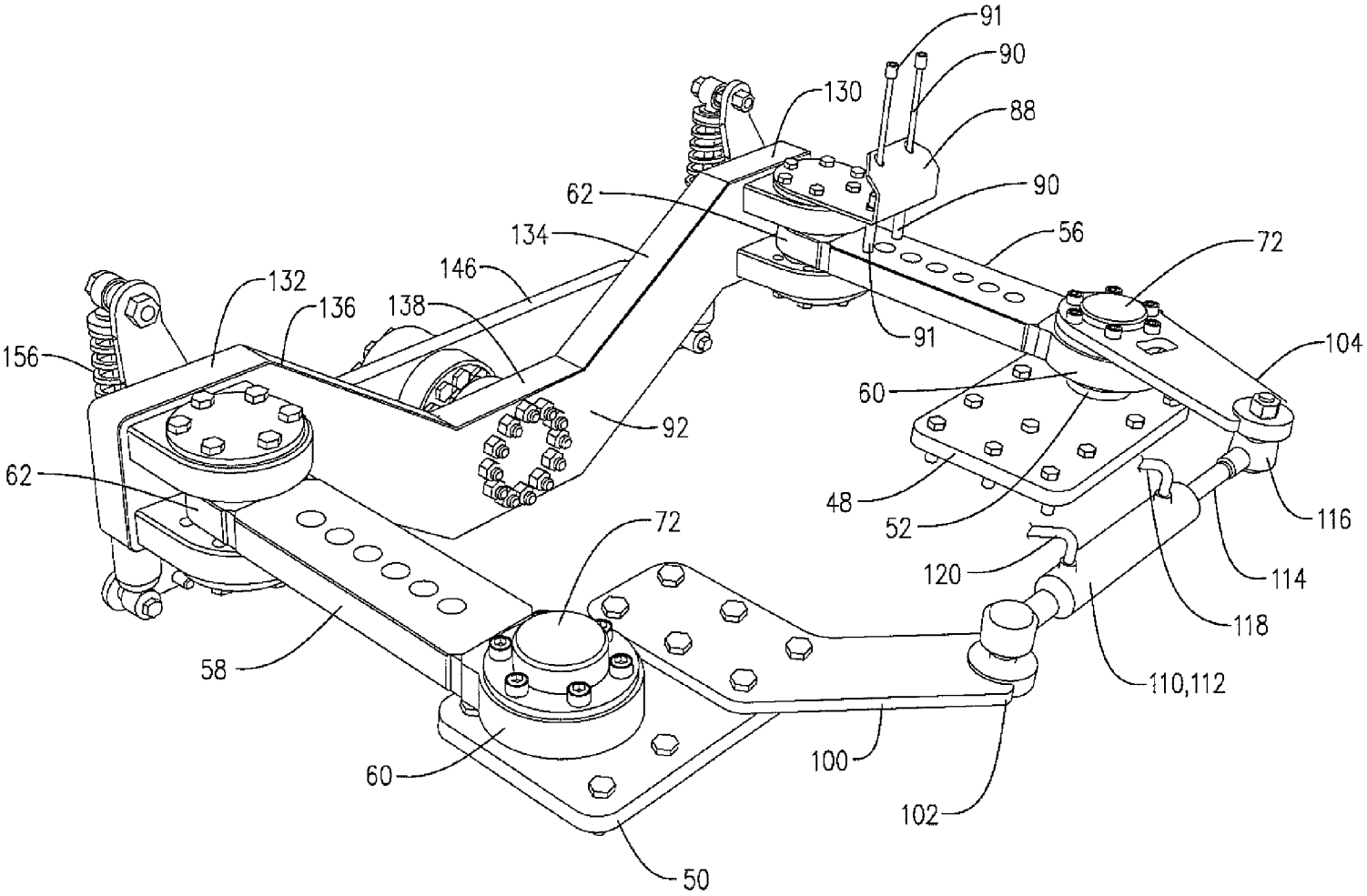

FIG. 1 shows an isometric view of the surface preparation apparatus disclosed herein. Surface preparation apparatus 10 comprises a wheeled vehicle 15 connected to a grinding head assembly 20. Wheeled vehicle 15 is a motor-powered vehicle. The vehicle motor, or engine may be a diesel engine, but may also be other types of motors, such as an electric motor. As will be explained in detail, grinding head assembly 20 includes a plurality of rotating tools for preparing the surface over which the apparatus 10 travels. The preparation of the surface may comprise grinding and/or polishing the surface with disks of varying grit size as known in the art. The rotating tools are powered by a power takeoff (PTO) drive connected to the vehicle motor, and as such the speed of the rotating tools will vary with the speed of the vehicle motor. Grinding head assembly 20 is an oscillating grinding head assembly 20 that in an oscillation mode will oscillate side to side as the wheeled vehicle 15 moves. Grinding head 20 can oscillate as the vehicle 15 travels in any direction. Surface preparation apparatus 10 can be operated in an oscillation or an non-oscillation mode as will be explained herein.

Referring now to FIGS. 1-13, grinding head, or grinding head assembly 20 comprises a grinding head housing 32 with a plurality of rotating grinding tools 34 which may simply be referred to as rotating tools 34. Rotating tools 34 are seen in FIG. 8. Grinding head 20 may be, for example, a Prep/Master® grinding head like that utilized on an STI-4430 Prep/Master® by Substrate Technology, Inc. Thus, for example, grinding tool 20 may include eight rotating tools 34 rotatably connected in grinding head housing 32. Each of the plurality of rotating tools 34 has three lobes 36 thereon and each lobe 36 may have a grinding puck or grinding disk thereon. Although the embodiment shown has eight rotating tools, more or less than eight rotating tools may be used, and the rotating tools may have more or less than three lobes. Grinding disks, or pucks, of varying grit size and materials may be utilized. Thus, for the surface being prepared, such as a concrete floor, coarse grit pucks may initially be used to grind the surface and remove surface irregularities. Finer grit pucks can be used and, with the apparatus 10 of the current disclosure, polishing pads may be used. For a concrete floor, the end result is a smooth, polished floor resembling polished granite or marble.

The embodiment shown utilizes a gear box 30 which is connected to the PTO with a shaft 25. Shaft 25 may be connected to the drive shaft 28 of gear box 30 with a U-joint connection 26, and may be connected to the PTO in a manner known in the art. As is known, shaft 25 is rotated by the vehicle motor so that the vehicle motor will drive rotating tools 34. While the STI-4430 Prep/Master® utilizes an electric motor, apparatus 10 utilizes gear box 30. The gear box 30 may be, for example, a modified Durst Model A76 gear box. Gear box 30 will be modified so that the shaft that extends from gear box 30 into the grinding head 20 will mate with the gear that drives rotating tools 34. In other words, a shaft from gear box 30 can be modified so that it is like the shaft extending from the electric motor that engages gears and drives the rotating tools in the STI-4430 Prep/Master®. The modification may require removal of the A76 shaft and machining of a new shaft so that the shaft is like the shaft used in the electric motor on an unmodified STI-4430. The flange on the gear box will be modified as well so that it matches the flange on the original electric motor. The flange will support bearings, which may be oversize bearings, for the gear box shaft that extends into grinding head housing 32.

Grinding head housing 32 has first and second bosses 44 and 46 which have coplanar upper surfaces. First, or right and second, or left plates 48 and 50, respectively, are fixed with bolts or other means to bosses 44 and 46. A pair of forward pins, which may comprise a first or right forward pin 52 and a second or left forward pin 54, are fixed to plates 48 and 50. The pins 52 and 54 may be welded or otherwise fixed to plates 48 and 50 and extend upwardly therefrom. Surface preparation apparatus 10 includes first or right pivot bar 56 and second or left pivot bar 58. Each of pivot bars 56 and 58 have a forward end 60 and a rear end 62. First and second pivot bars 56 and 58 rotate or pivot about first and second pins 52 and 54, respectively, at the forward ends 60 thereof. A bearing 64 which may be, for example, a spherical ball bearing 64, is mounted in the forward ends 60 of both of pivot bars 56 and 58. One type of bearing that may be used is a GEZ-ES-2RS series bearing manufactured by AST bearings. Bearing 64 is held in place by a bolt 66 and washer 68 and by a shoulder 70 defined on pins 52 and 54. A cap 72 is bolted to the forward ends of both of first and second pivot bars 56 and 58, and also holds bearing 64 in place. First and second pivot bars 56 and 58 are thus rotatable or pivotable about first and second pins 52 and 54. Bearings 64, because they are spherical ball bearings, also allow grinding head 20 to pivot in the forward and rear direction. Grinding head 20 is thus a self-leveling head. In other words, when grinding head 20 is in a raised position, it will pivot to a level position. Grinding head 20 will also float as it moves over a surface since it is pivotable in a plurality of directions.

First and second rear pins 74 and 75 are welded or otherwise fixed to first and second pivot bars 56 and 58 at the rear ends thereof. Pins 74 and 75 extend above and below pivot bars 56 and 58. Pins 74 and 75 extend into opposed lugs and thus extend upwardly into upper or top lug 76 and downwardly into lower or bottom lug 78. Each of lugs 76 and 78 have a bearing 80 fixed therein. Caps 82 are fixed by bolts or otherwise to the rear end 62 of both of pivot bars 56 and 58. Caps 82 along with upward facing shoulder 84 and downward facing shoulder 86 hold bearings 80 in place. Bearings 80 may be spherical ball bearings like those described above, but also may be other types of bearings that will allow rotation of pins 74 and 75 so that pivot bars 56 and 58 are pivotable or rotatable at rear ends 62 thereof. The distance from the center of pins 74 and 75 to the center of pins 52 and 54 is, in the embodiment disclosed, identical. A bracket 88 may also be connected to the upper lug 76 at the rear end 62 of pivot bar 56. Proximity switches 90 and 91 are attached to bracket 88 and may be used to limit the distance that pivot bars 56 and 58 move, which will limit the distance that grinding head 20 will oscillate as hereinafter described. Each of lugs 76 and 78 are fixed to a back plate 92 by welding or as shown in the figures with a plurality of bolts.

A fixed arm 100 is mounted with bolts or otherwise to plate 50 and has an end 102. A pivot arm 104 with a first or rear end 106 and a second or forward end 108 is attached to the forward end 60 of pivot bar 56. Rear end 106 is connected to pivot bar 56 with bolts that extend through cap 72. A hydraulic cylinder 110 extends between and is rotatably connected to end 102 of fixed arm 100 and to second or forward end 108 of pivot arm 104. Hydraulic cylinder 110 comprises a cylinder barrel 112 with a cylinder or piston rod 114 extending therefrom. As is known in the art, a piston will be connected to an end of the cylinder rod and will reciprocate in cylinder barrel 112 such that the end 116 of piston rod 114, which is connected to pivot arm 104, will reciprocate. Hoses 118 and 120 will be connected to hydraulic cylinder 110 and will apply pressure to cause the piston rod 114 to reciprocate. Hydraulic pressure will be applied by a pump which will be driven by the vehicle motor in a manner known in the art. An exemplary fluid circuit is shown schematically in FIG. 10. A pump 121, which will be driven by the vehicle motor, is fluidicly connected to a variable flow valve 122. Pump 121 is connected to a fluid source, like tank 123. Tank 123 will be mounted to and will travel with vehicle 15.

Figure 12:
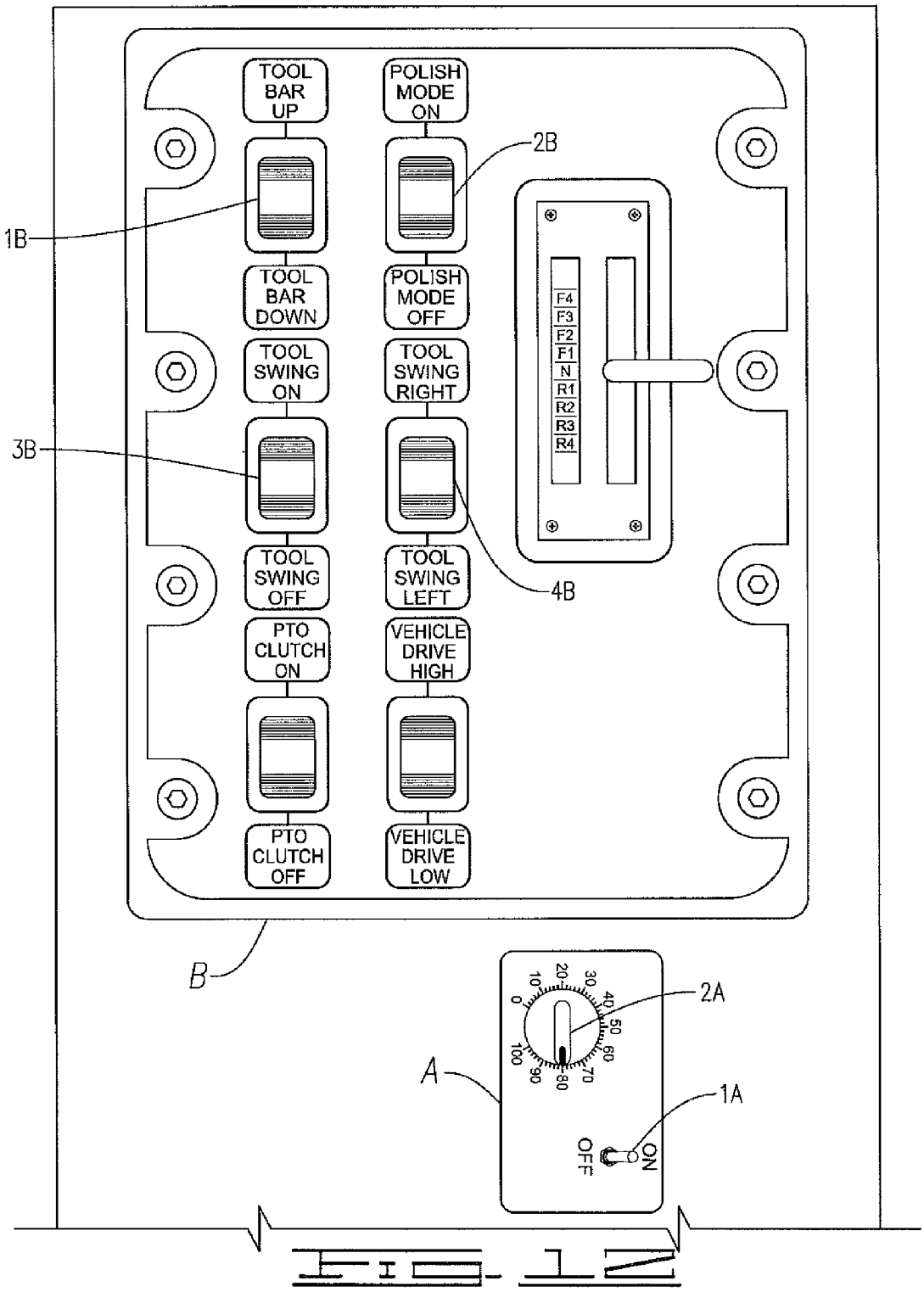
FIG. 12 shows two operating panels.
Figure 13:
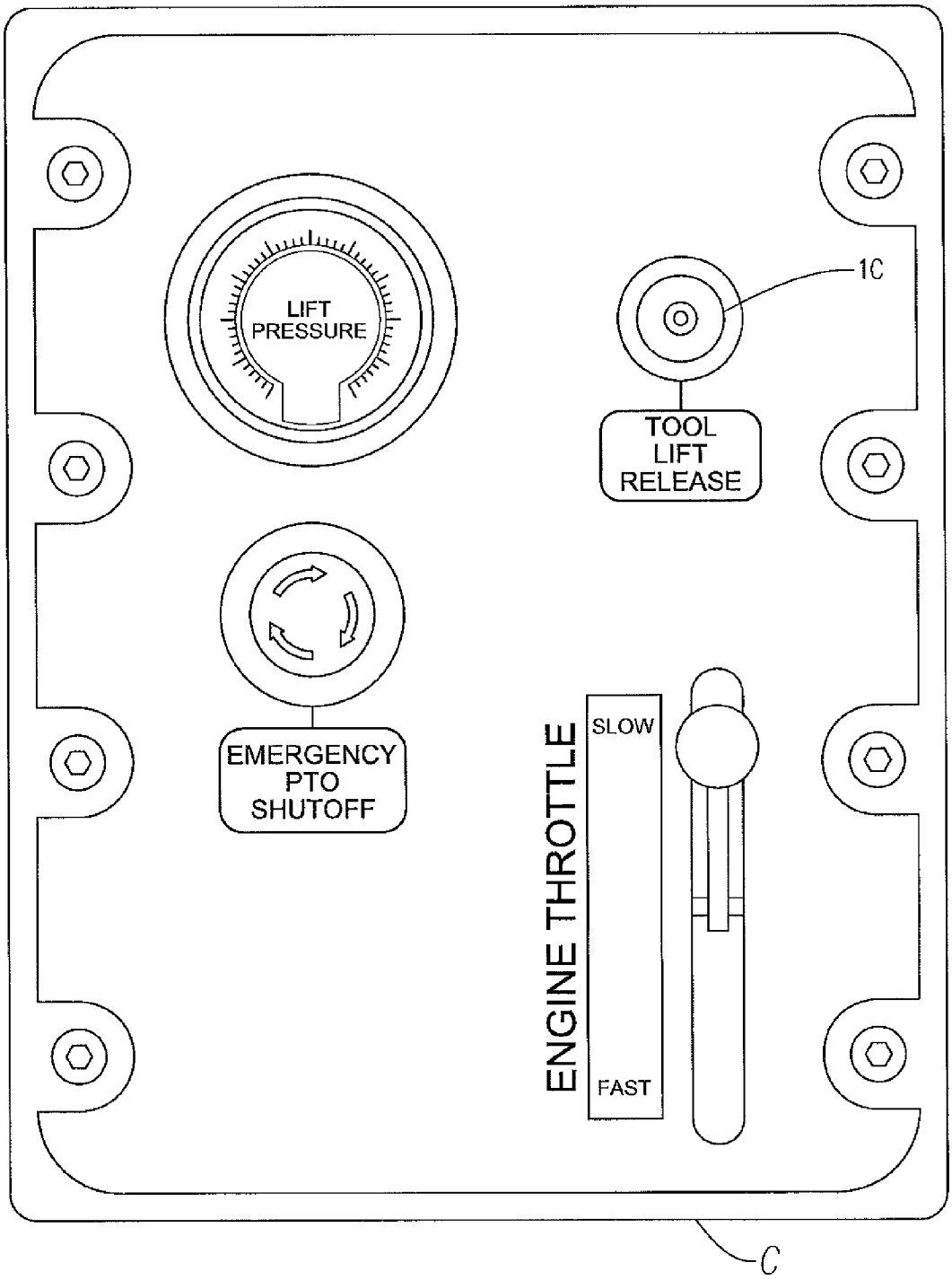
FIG. 13 shows a single operating panel.

FIG. 12 shows a view of two control panels, one identified with the letter A and the second with the letter B. Control panel A has an on-off switch 1A and a control knob 2A. On-off switch 1A is electrically connected to valve 122. When the engine motor is on and on-off switch 1A is in the off position hydraulic fluid will flow through valve 122 and circulate into tank 123 through line C, and from tank 123 through pump 121. Grinding head 20 is in a non-oscillating mode when switch 1A is off. When the on-off switch 1A is in the on position, so that apparatus 10 is being operated in an oscillation mode, pump 121 delivers fluid to valve 122 through line V and valve 122 is operated so that fluid flows therethrough to a valve 124. Control knob 2A controls the flow rate of the fluid from valve 122 to valve 124, which may be a three-way valve 124.

Thus, when switch 1A is on so that apparatus 10 is in oscillation mode, fluid will pass through valve 124 and will be directed to either hose 118 or 120. The speed of the oscillation is controlled by control knob 2A which controls the flow rate of hydraulic fluid. When the speed of the motor varies, pump 121 will vary the amount of fluid delivered to the valve 122. By way of example, if control knob 2A is set to provide 3 gal/min to valve 124, valve 122 will allow only 3 gal/min to valve 124, independent of the motor speed. If the speed of the motor slows to a level such that less than 3 gal/min is provided to valve 122, all of the fluid will flow to valve 124. If motor speed is such that more than 3 gal/min is supplied to valve 122, only 3 gal/min is provided to valve 124, and the remainder is directed to tank 123 through line C. When fluid is delivered through hose 120, piston rod 114 extends and pushes end 108 of arm 104 which causes rotation of pivot plate 56 relative to pin 52 in the counter clockwise direction. Grinding head 20 will move to the left from a driver's perspective. Proximity switch 90 is positioned such that when the desired oscillation stroke, or oscillation distance is reached, a solenoid valves on valve 124 will be activated to provide flow to hose 118 to reverse the direction of grinding head 20. Fluid on the left of the piston as viewed in FIG. 10 will be delivered to tank 123 through relief line R. Proximity switches 90 and 91 are electrically connected to valve 124 through relays or other means known in the art. Thus, grinding head 20 oscillates laterally or transverse to the direction of travel of vehicle 15. As described above, the speed of the oscillation may be altered by changing the flow rate through valve 124, which in one embodiment may be varied from 0 gal/min to as much as 5 gal/min. While higher flow rates to generate higher speed are possible, consideration must be given to wear and tear on the equipment, and the speed should be limited to achieve the most efficient grinding and/or polishing speed.

Back plate 92 has first or right end 130 and second or left end 132. Each of the ends may define rectangular section for connecting mounting lugs 76 and 78 thereto. Connecting sections 134 and 136 extend downward at an angle from the ends 130 and 132. Connecting sections 134 and 136 are connected to a center section or mounting section 138. A shaft 140 is rigidly fixed to back plate 92 at center section 138. Shaft 140 may extend from a plate 142 that is bolted to center mounting section 138. Shaft 140 extends through a connecting plate 146. Connecting plate 146 has a first or right end 148 and a second or left end 150. Bearings 152 are connected to connecting plate 146 and shaft 140 extends therethrough. Shaft 140 is rotatable in bearings 152 so that back plate 92 will pivot or rotate relative to connecting plate 146. Because back plate 92 pivots, grinding head 20 will pivot relative to connecting plate 146. As is apparent from FIG. 4, back plate 92 and grinding head 20 will pivot about an axis 154 which will generally be parallel to the direction of travel of vehicle 15 when the vehicle is travelling in a straight line. A pair of shock absorbers 156 are connected at the upper ends 157 thereof to shock absorber brackets 158 that are connected to back plate 92. Lower ends 160 of the shock absorbers 156 are connected to brackets 162 and 164 that are connected to connecting plate 146. Each shock absorber 156 has a spring 166 disposed thereabout. Springs 166 provide a biasing force so that when in a raised position, grinding head 20 will travel in a level position. When apparatus 10 is in use and grinding head 15 engages the surface being prepared, shock absorbers 156 and springs 166 will not generally be in use. When grinding head 20 is lifted from the surface and vehicle 15 travels with grinding head 20 in a lifted position, shock absorbers 156 will reduce the bounce, or dampen the effect of travelling over a rough surface and springs 166 help to maintain grinding head 20 in a level position.

A connecting structure 170 is connected to connecting plate 146 by welding, or other means. Connecting structure 170 is pivotably connected to the frame of vehicle 15. Hydraulic cylinders 174 and 176 are connected at upper ends 178 to the vehicle 15 and at lower ends 180 to connecting structure 170. Connecting structure 170 may comprise side plates 182 connected at forward ends 184 thereof to connecting plate 146, A cross bar 183 may be connected to side plates 182. Longitudinal plates 185 may be welded to cross bar 183 and connecting plate 146. Side plates 182 may have an arcuate, or U-shaped portion that passes over the axle of the vehicle 15. Side plates 182 have rear ends 186 that are pivotably connected to a frame of vehicle 15.

Figure 7:
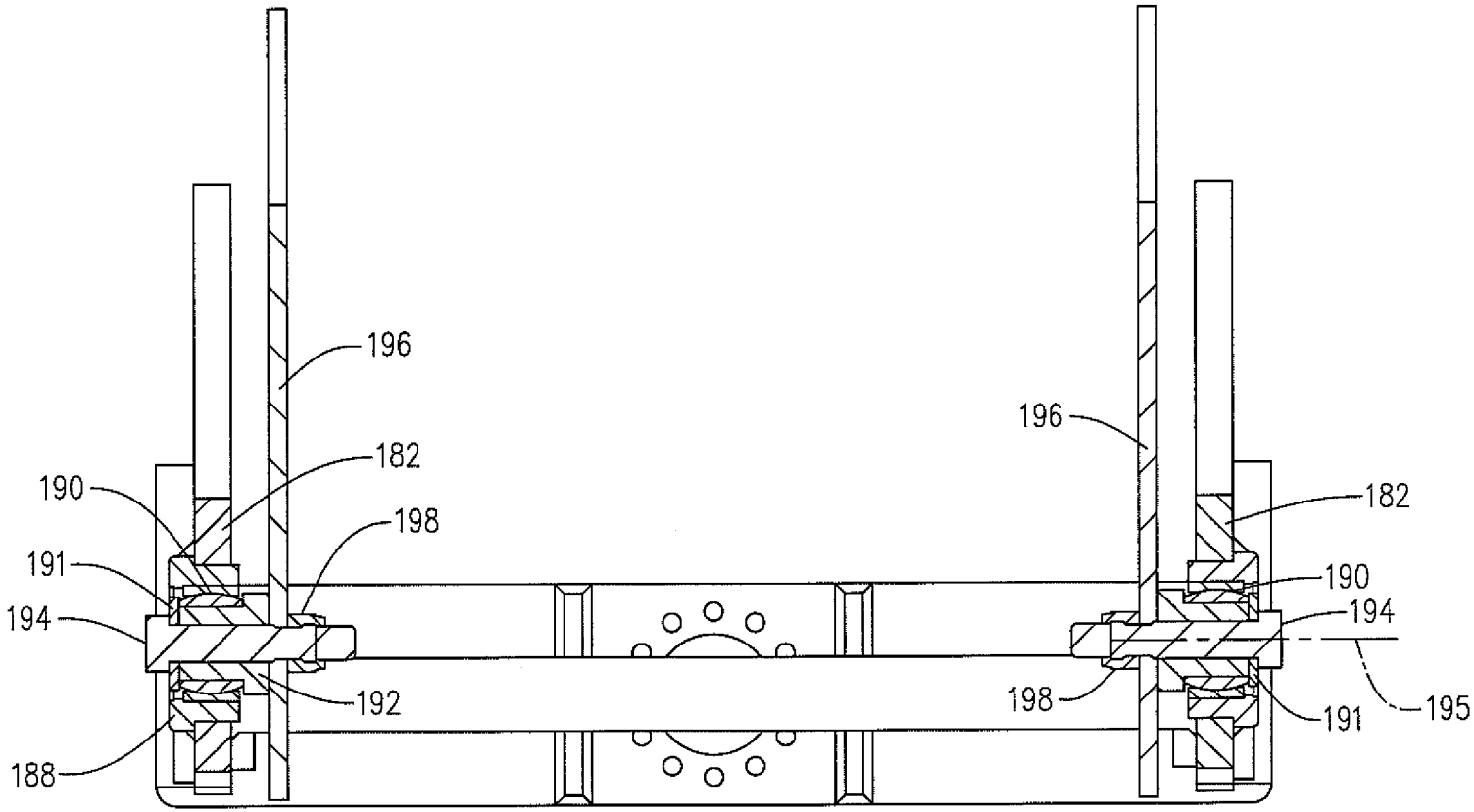
FIG. 7 is a section view showing the pivotable connection to the wheeled vehicle.
Figure 8:
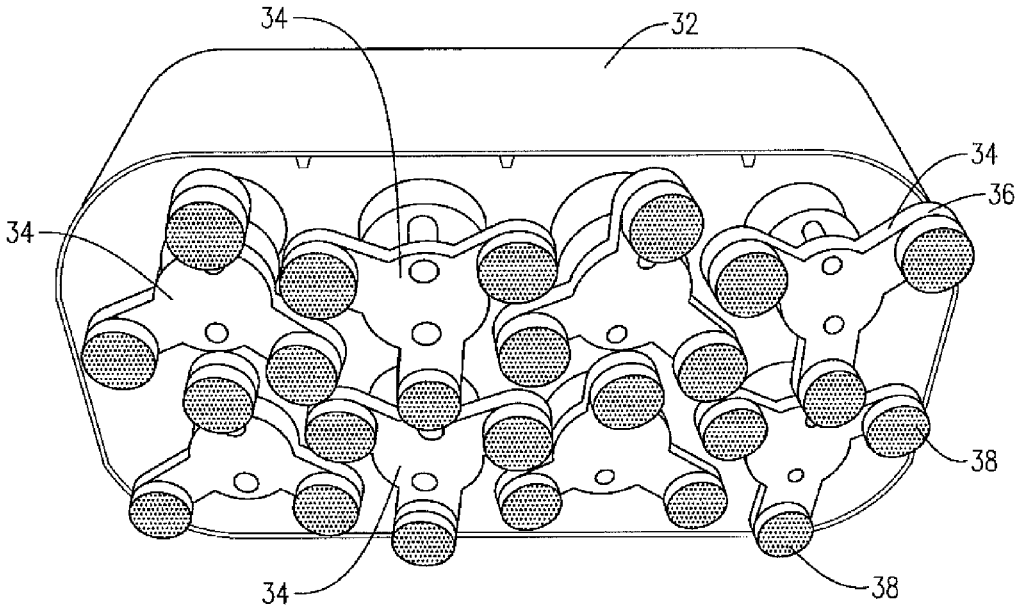
FIG. 8 is a bottom view of the grinding head of the preparation apparatus.

FIG. 7 is a section view of the connection at rear end 186. A sleeve 188 may have spherical bearing 190 pressed therein. Sleeve 188 may be welded to side plate 182. Spherical bearings 190 may be like those described above and may be mounted in plate 188 and disposed about a bushing 192. A fastener 194 may extend through bushing 192 and fixed to the vehicle frame 196 with a nut 198. A washer 191 may be used to help hold bearings 190 in place. Connection structure 170 will pivot about pin 194. Thus, grinding head 20 is pivotable about pins 194, and is pivotable, or rotatable about an axis 195. Axis 195 is transverse to the longitudinal axis of the vehicle and thus transverse to the travel direction of vehicle 15 when vehicle 15 travels in a straight line.

Hydraulic cylinders 174 and 176 are operated with a pump in a manner known in the art. The pump is driven by the vehicle motor and is a separate pump than that used to operate hydraulic cylinder 110 that oscillates grinding head 20. Cylinders 174 and 176 may be used to raise and lower grinding head 20. The pump that drives cylinders 174 and 176 is connected to tank 123 which is the source of hydraulic fluid.

Figure 11:
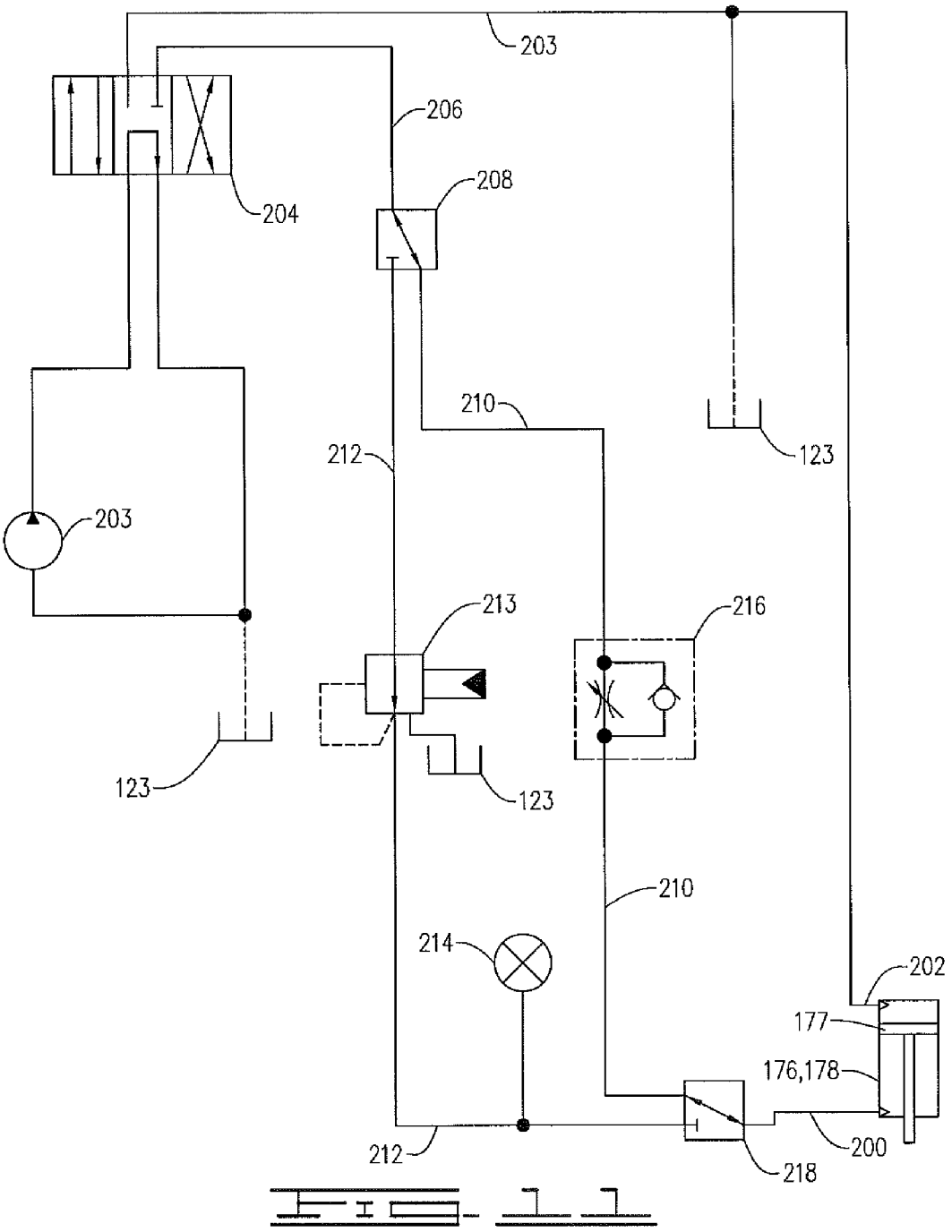
FIG. 11 is an exemplary circuit for the lifting cylinders of the surface preparation apparatus.

FIG. 11 is an exemplary fluid circuit for cylinders 174 and 176, which will be described with reference to panel B in FIG. 12. Panel B has a tool bar up and tool bar down switch 1B. In the tool bar up position, hydraulic pressure is applied through hoses 200 in each of cylinders 174 and 176 to lift structure 170, which lifts grinding head 20. Pump 201 is driven by the vehicle motor and is pumping fluid when the motor is on. When the tool bar switch up is activated, valve 204 is energized to allow flow through line 206, valve 208, line 210, one way restrictor 216, valve 218 and hose 200 which will move pistons 177 upwardly, and as a result move connecting structure 170 along with grinding head 20 upwardly. The tool bar up switch must be held in the up position until the grinding head 20 has been lifted to the desired position for travelling in a non-operational mode. When switch 1B is placed in the tool bar down position, the hydraulic pressure is relieved and fluid is delivered from hoses 200 into tank 123. Panel B also has a polish mode on/polish mode off switch 2B. When switch 1B is in the tool bar down position and switch 2B is in the polish mode off position, the full weight of tool 20 is acting on the surface. Fluid will circulate through valve 204, tank 123 and pump 201. When switch 2B is moved to the polish mode on position, valve 204 is energized to provide flow to line 206 and bypass valve 208 is activated so that fluid flows through line 212, pressure reducing valve 2B and bypass valve 218, which is also activated in polish mode on. Fluid is thus provided to hoses 200 so that a lifting pressure is applied to pistons 177 in both of cylinders 174 and 176. The pressure is adjustable with control knob 1C shown in panel C in FIG. 13, which is operably connected to and controls valve 213. Thus, the weight applied can be adjusted from the maximum weight of grinding head 20 to almost zero by adjusting the lifting pressure. The polish mode is used generally near the end of the surface treatment for smoothing and polishing The tool swing on and tool swing off switch 3B is used to place the surface preparation apparatus 10 in either the oscillating or non-oscillating mode. When switch 3B is in the off position and the PTO clutch is on and polish mode is off, grinding head 20 will operate and rotating heads 34 will rotate and grind material from the surface being prepared, but no oscillation occurs. When the tool swing switch 3B is in the tool swing on position, power is provided to proximity sensors 90 and 91, so that the tool will oscillate in the manner described herein when switch 1A is in the on position.

Switch 4B is a tool swing right and tool swing left override switch that will manipulate the hydraulic cylinder 110 to move the grinding head 20 right or left when the switch 1A is off. This allows manipulation of grinding head 20 for loading purposes, or when it is desired to swing grinding head 20 a specific amount to grind or smooth against a wall or other barrier. Switch 4B is a temporary switch in that it must be held in place and when released switch 4B will go back to the center, or off position. Switch 4B is electrically connected to the valves that control cylinder 110 by means known in the art.

Grinding head 20 is self-levelling, in that grinding head 20 will hang in a generally horizontal position when raised and in a non-operating position, and will land level on the surface. As described herein, grinding head 20 pivots about axis 195, which is perpendicular to a longitudinal axis of vehicle 15, and perpendicular to a straight line direction of travel. Connecting structure 170, along with back plate 92, and connecting plate 146 likewise pivot about axis 195. Grinding head 20 also pivots about axis 154, which is parallel to the straight line direction of travel, and perpendicular to axis 195. Back plate 92 pivots with grinding head 20. Finally, grinding head 20 pivots, or rotates independently about bearings 64. Grinding head 20 will pivot, or rock back and forth on bearings 64 independent of other pivoting or rotation. The rocking, or pivoting is about an axis parallel to axis 195. Because of the multiple axes about which grinding head 20 pivots, and because of the ability of grinding head 20 to rock or pivot independent of other structures, grinding head 20 can be said to float over a surface to react to surface irregularities.

Figure 9:
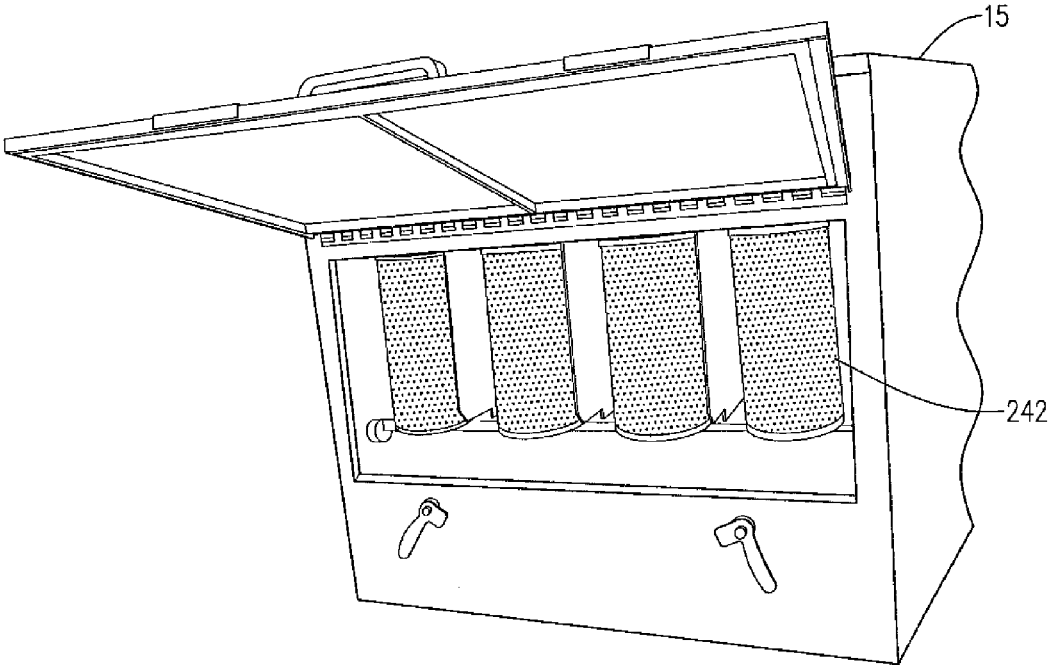
FIG. 9 is a view showing the dust collector compartment of the apparatus.
Figure 10:
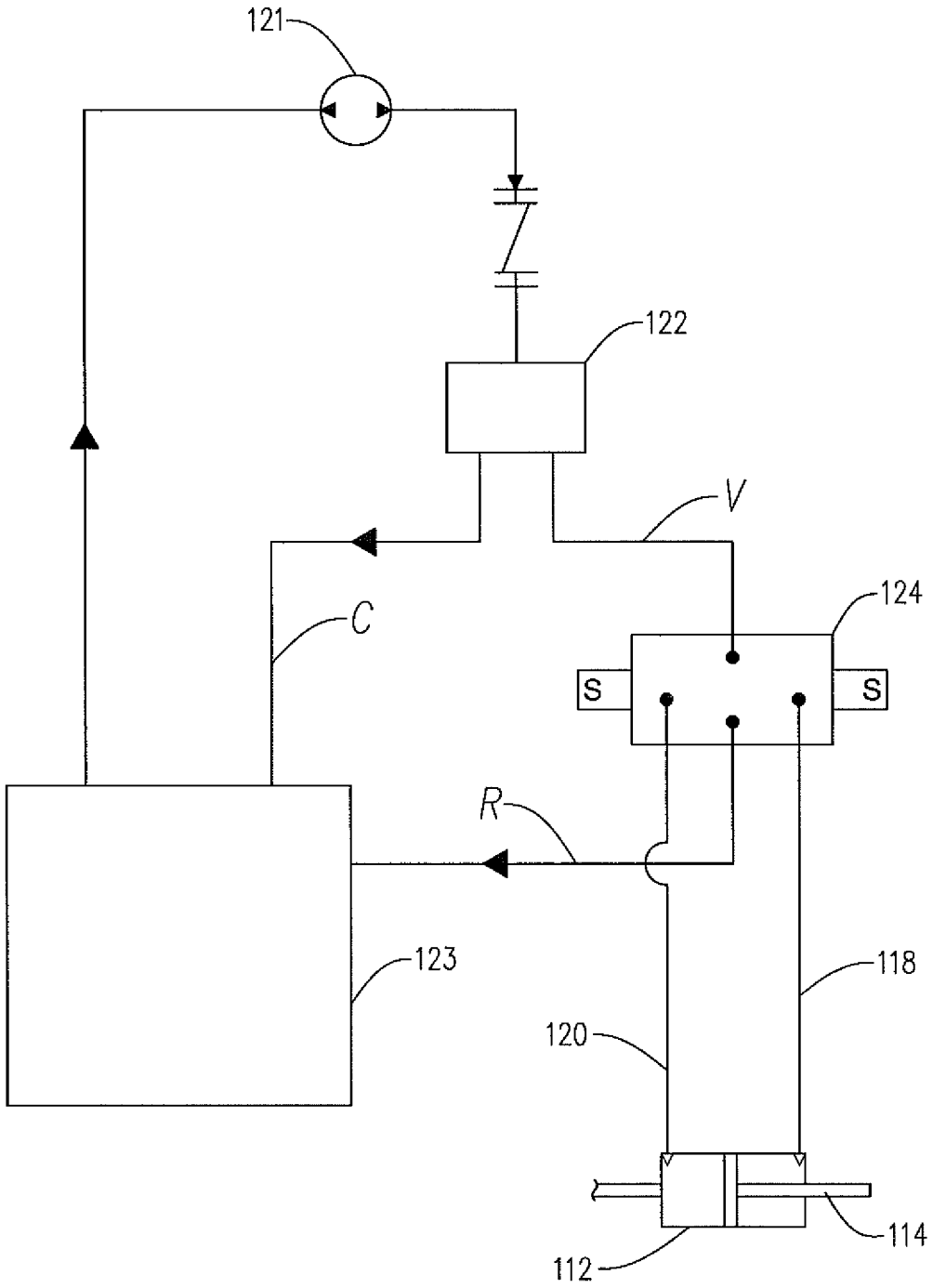
FIG. 10 is an exemplary fluid circuit for the oscillating grinding head of the surface preparation apparatus.

A dust container 230 may be mounted to the rear of grinding tool housing 32, and has a pipe 232 extending therefrom. A hose 240 may extend from pipe 232 through an opening 236 in the vehicle frame, and will deliver dust to the dust collectors 242 shown in FIG. 9. As is apparent, the dust collectors may be fully contained in the vehicle 15. FIG. 9 schematically shows the dust collector compartment on the left side of vehicle 15, when viewed from the front of the vehicle.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A surface preparation apparatus comprising:

a motor powered wheeled vehicle;

a grinding head assembly movable with the wheeled vehicle for grinding material from a surface over which the wheeled vehicle travels, wherein the grinding head assembly will oscillate laterally relative to the direction of travel of the vehicle; and a lifting mechanism powered by the vehicle motor for applying an upward force to the grinding head, so that the downward force applied to the surface resulting from the weight of the grinding head can be adjusted as the vehicle travels over the surface, wherein the lifting mechanism comprises a pair of hydraulic cylinders mounted at one end to the vehicle and at a second end to a grinding head connection structure and wherein the hydraulic cylinders are operable to adjust the weight applied by the grinding head assembly to the surface from a maximum weight of the grinding head assembly to zero.

2. The surface preparation apparatus of claim 1, the grinding head assembly comprising a grinder housing and a plurality of rotating tools in the grinder housing, each rotating tool having at least one grinding puck attached thereto for grinding the surface, wherein the motor that powers the vehicle provides the motive force for the rotating tools.

3. The surface preparation apparatus of claim 2 further comprising a hydraulic cylinder mounted to the grinder housing, the hydraulic cylinder comprising a cylinder barrel and a piston rod reciprocable therein, wherein reciprocating motion of the piston rod causes the grinding head assembly to oscillate.

4. The surface preparation apparatus of claim 3 wherein a pump for driving the piston rod is powered by the motor that powers the vehicle.

5. The surface preparation apparatus of claim 2 wherein the grinding head assembly is pivotable about an axis parallel to a straight line direction of travel of the vehicle.

6. The surface preparation apparatus of claim 5, wherein the grinding head assembly is pivotable about an axis perpendicular to the straight line direction of travel of the vehicle as it moves along the surface.

7. A surface preparation apparatus comprising:

a motor powered wheeled vehicle; and an oscillating grinding head pivotably connected to the wheeled vehicle so that the grinding head will pivot about a first axis parallel to the direction of travel of the vehicle as the grinding head is moved in a straight line along the surface by the wheeled vehicle, wherein the motive force for oscillating the grinding head is generated by the vehicle motor.

8. The surface preparation apparatus of claim 7, wherein the grinding head will oscillate transverse to the direction of travel of the vehicle.

9. The surface preparation apparatus of claim 7 wherein the grinding head is pivotable about a second axis, the second axis being perpendicular to the first axis.

10. The surface preparation apparatus of claim 7, the grinding head comprising:

a grinding head housing; and a plurality of rotatable tools disposed in the housing, wherein the vehicle motor provides the power to rotate the tools.

11. The surface preparation apparatus of claim 7 further comprising:

a hydraulic cylinder comprising a cylinder barrel with a piston rod reciprocable therein mounted on the grinding head; and a hydraulic pump for driving the hydraulic cylinder, wherein the hydraulic pump is powered by the vehicle motor and wherein the reciprocation of the piston rod causes the grinding head to oscillate.

12. The surface preparation apparatus of claim 7, further comprising:

first and second pivot bars pivotably connected at first ends to the grinding head and pivotably connected at second ends thereof to a back plate; and a hydraulic cylinder fixedly connected at one end to the grinding head, wherein reciprocating movement of the piston rod in the hydraulic cylinder causes the first and second pivot bars arms to pivot at the first and second ends thereof and oscillate the grinding head.

13. The surface preparation apparatus of claim 7, further comprising an adjustment mechanism for adjusting the weight applied to the surface by the grinding head.

14. A surface preparation apparatus comprising:

a motor powered wheeled vehicle;

a grinding head assembly movable with the wheeled vehicle for grinding material from a surface over which the wheeled vehicle travels, wherein the grinding head assembly will oscillate laterally relative to the direction of travel of the vehicle and is pivotable about an axis parallel to a straight line direction of travel of the vehicle, the grinding head assembly comprising a grinder housing and a plurality of rotating tools in the grinder housing, each rotating tool having at least one grinding puck attached thereto for grinding the surface, wherein the motor that powers the vehicle provides the motive force for the rotating tools; and a lifting mechanism powered by the vehicle motor for applying an upward force to the grinding head, so that the downward force applied to the surface resulting from the weight of the grinding head can be adjusted as the vehicle travels over the surface.

15. The surface preparation apparatus of claim 14 further comprising a hydraulic cylinder mounted to the grinder housing, the hydraulic cylinder comprising a cylinder barrel and a piston rod reciprocable therein, wherein reciprocating motion of the piston rod causes the grinding head assembly to oscillate.

16. The surface preparation apparatus of claim 15 wherein a pump for driving the piston rod is powered by the motor that powers the vehicle.

17. The surface preparation apparatus of claim 14, wherein the grinding head assembly is pivotable about an axis perpendicular to the straight line direction of travel of the vehicle as it moves along the surface.

18. The surface preparation apparatus of claim 14 wherein the lifting mechanism comprises a pair of hydraulic cylinders mounted at one end to the vehicle and at a second end to a grinding head connection structure, wherein the hydraulic cylinders are operable to adjust the weight applied by the grinding head assembly to the surface from a maximum weight of the grinding head assembly to zero.

* * * * *